US005560129A

United States Patent [19]

Rothbart

[11] Patent Number: 5,560,129

[45] Date of Patent: Oct. 1, 1996

[54] PLOW ATTACHMENT FOR A FORKLIFT TRUCK

[76] Inventor: Michael B. Rothbart, 1204 Hohlfelder Rd., Glencoe, Ill. 60022

[21] Appl. No.: 336,990

[22] Filed: Nov. 14, 1994

[51] Int. Cl.[6] ..... E01H 5/04; B66F 13/00

[52] U.S. Cl. ..... 37/231; 37/233; 37/266; 37/403; 37/407; 414/607; 414/723; 414/912

[58] Field of Search ..... 37/403, 405, 407, 37/410, 233, 231, 266; 414/607, 642, 912, 723

[56] References Cited

U.S. PATENT DOCUMENTS

| | | | |
|---|---|---|---|
| 2,584,240 | 2/1952 | Stewart | 214/113 |
| 2,709,269 | 5/1955 | Williams | 414/607 X |
| 3,115,261 | 12/1963 | Antolini | 37/405 X |
| 3,230,645 | 1/1966 | Lutz | 37/50 |
| 3,470,631 | 10/1969 | Grimes | 37/42 |
| 3,472,404 | 10/1969 | Ord | 414/607 X |
| 3,845,577 | 11/1974 | Naymik | 37/231 |
| 4,216,833 | 8/1980 | Fezatt et al. | 37/283 X |
| 4,328,628 | 5/1982 | Thomas | 37/403 X |
| 4,545,721 | 10/1985 | Pettersson | 414/912 X |
| 4,821,436 | 4/1989 | Slocum | 37/235 |
| 4,845,866 | 7/1984 | Ciula | 37/266 |
| 4,873,775 | 10/1989 | Richey | 37/231 |
| 4,962,598 | 10/1990 | Woolhiser et al. | 37/279 |
| 5,056,982 | 10/1991 | Stockham | 414/607 |
| 5,129,170 | 7/1992 | Fusilli | 37/231 |
| 5,366,339 | 11/1994 | Gould | 414/607 |

FOREIGN PATENT DOCUMENTS

| | | | |
|---|---|---|---|
| 277077 | 8/1988 | France | 414/607 |
| 403192097 | 8/1991 | Japan | 414/607 |
| 1643445 | 4/1991 | U.S.S.R. | 414/607 |

OTHER PUBLICATIONS

"Snow Removal Equipment", Brochure By Waldon, Celstar Company.

Snow Plow For Loaders Clamps onto Bucket Lip, Bulletin 90-6 By Guest Industries, Inc (1990).

"Little Giant Attachments", Brochure No. 9388, Little Giant Products, Inc.

*Primary Examiner*—Randolph A. Reese
*Assistant Examiner*—Thomas A. Beach
*Attorney, Agent, or Firm*—Adam H. Masia; Lloyd L. Zickert

[57] ABSTRACT

An attachment for a forklift truck to facilitate the removal or clearing of snow or other materials and debris with the truck, including a frame having two rectangular elongated tubes adapted to receive the tines of the forklift, a plurality of transversely extending crossbars connecting said tubes together, ground-engaging members attached to each tube, a plow blade pivotally attached to the frame, and a shear pin assembly connected between the blade and the frame preventing uneven ground and/or obstructions on the ground from damaging the blade.

28 Claims, 3 Drawing Sheets

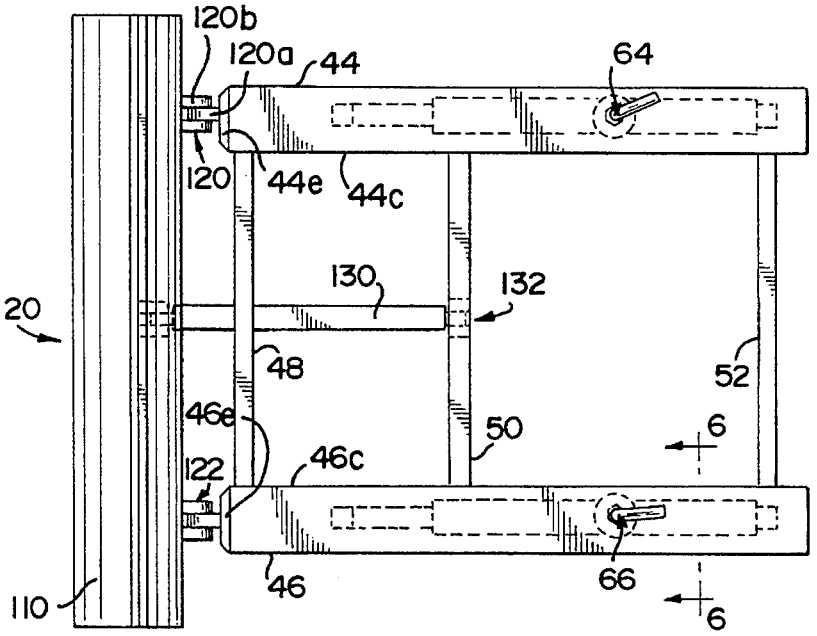
FIG. 4
FIG. 6
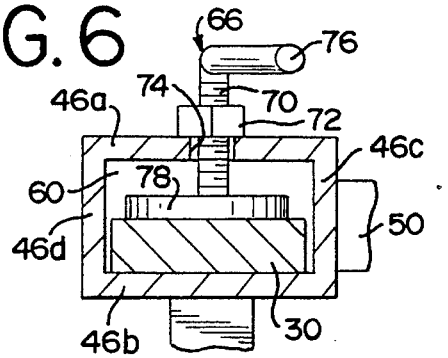
FIG. 7
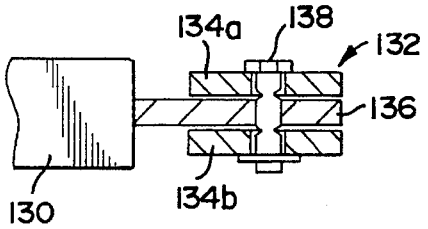
FIG. 5
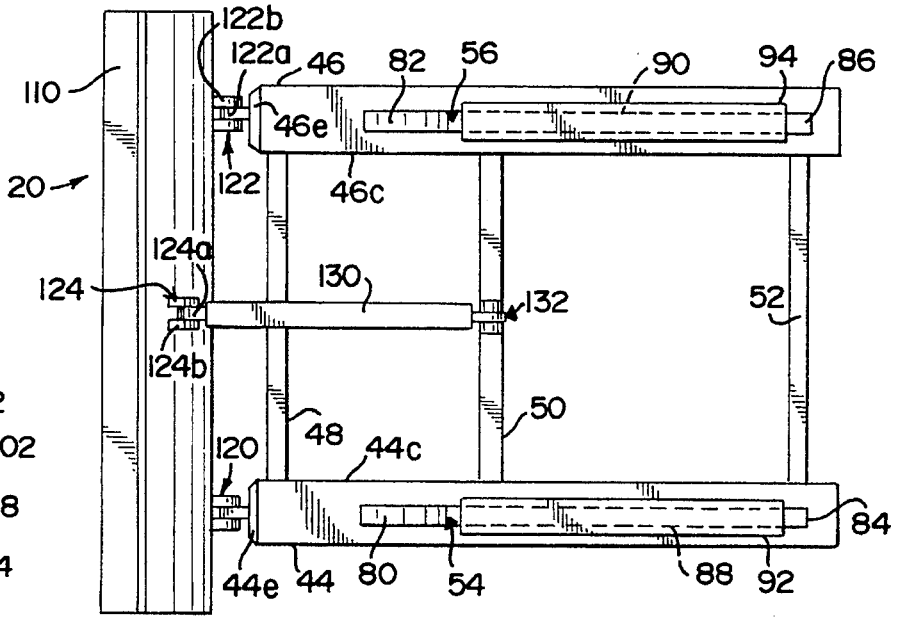
FIG. 8
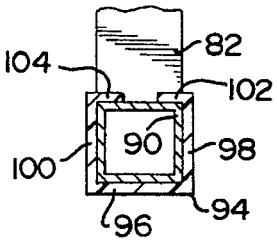

PLOW ATTACHMENT FOR A FORKLIFT TRUCK

DESCRIPTION

This invention relates in general to an attachment for a forklift truck, and more particularly to a plow attachment for a forklift truck which can be easily and quickly secured to the tines of the forklift truck to facilitate the moving of material along the ground with the forklift, such as the removal and clearing of snow.

BACKGROUND OF THE INVENTION

Heretofore, it has been well known to use plow attachments on the front of vehicles such as light and heavy-duty trucks for moving materials along the ground, such as snow removal and clearing and for other purposes. It has also been known to attach a plow to a forklift truck. For example, U.S. Pat. No. 3,470,631 shows a floating hitch construction for a snowplow attachment for a self-powered lift truck. However, such devices available on the market are bulky, complex, and relatively expensive. Accordingly, there is a need for an inexpensive and simple plow attachment for a forklift truck which can be easily and quickly attached and detached from the tines of the forklift truck. Moreover, since such a device may only be infrequently used, the device should be compact, requiring minimum storage space when not in use.

SUMMARY OF THE INVENTION

The present invention overcomes the above problems in providing a plow attachment for a forklift truck which has a simple, inexpensive, and compact construction, which requires little storage space, and which can be easily attached to or detached from the tines of a forklift truck to remove or clear snow or other materials.

More particularly, the plow attachment of the present invention includes a frame which is adapted to be releasably connected to the tines and a blade assembly connected to the frame at the end opposite the tines. The frame generally includes spaced-apart elongated tubular members or tubes adapted to releasably receive the tines. The tubular members are interconnected by three spaced-apart transversely extending crossbars. Each tubular member has a ground-engaging member extending downwardly from the bottom of each tube to the ground, and each ground-engaging member includes a replaceable plastic shoe for engagement with the ground. The blade assembly including a blade and replaceable resilient sweep member, is pivotally attached to the tubular members of the frame. A shear pin assembly is connected between the blade and the frame to accommodate abnormal forces subjected to the blade by obstructions in the path of the blade by releasing the blade from the plow position thereby protecting the blade against damage. A further embodiment of the invention includes a hinged connection between the tubular members and the crossbars to allow the angling of the blade in either direction.

It is therefore an object of the present invention to provide a plow attachment for a forklift truck which has a simple, compact, and inexpensive construction.

A further object of the present invention is to provide a plow attachment for a forklift truck which can be easily attached to and detached from the tines of the forklift truck.

A further object of the present invention is to provide a plow attachment for a forklift truck which prevents damage to the blade by obstructions on the ground.

Another object of the present invention is to provide a plow attachment for a forklift truck for removing and clearing snow from the ground.

Another object of the present invention is to provide a plow attachment for a forklift truck which requires little storage space when not in use.

A further object of the present invention is to provide a plow attachment for a forklift truck which can be easily assembled and disassembled.

A still further object of the present invention is to provide a plow attachment for a forklift truck which is easily adjusted on the tines of the forklift truck to vary the angle of the blade.

Other objects, features, and advantages of the invention will be apparent from the following detailed disclosure, taken in conjunction with the accompanying sheets of drawings, wherein like reference numerals refer to like parts.

DESCRIPTION OF THE DRAWINGS

FIG. 4 is a top plan view of the plow attachment;

FIG. 5 is a bottom plan view of the plow attachment;

FIG. 6 is an enlarged sectional view of the locking mechanism on the tubular member of the plow attachment positioned on a tine and taken substantially along line 6—6 of FIG. 4;

FIG. 7 is an enlarged cross-sectional view of the knuckle joint and shear pin assembly on the frame taken substantially along line 7—7 of FIG. 2;

FIG. 8 is a cross-sectional view of the shoe mounted on the foot of the ground engaging member taken substantially along line 8—8 of FIG. 2;

DESCRIPTION OF THE INVENTION

Figure 1:
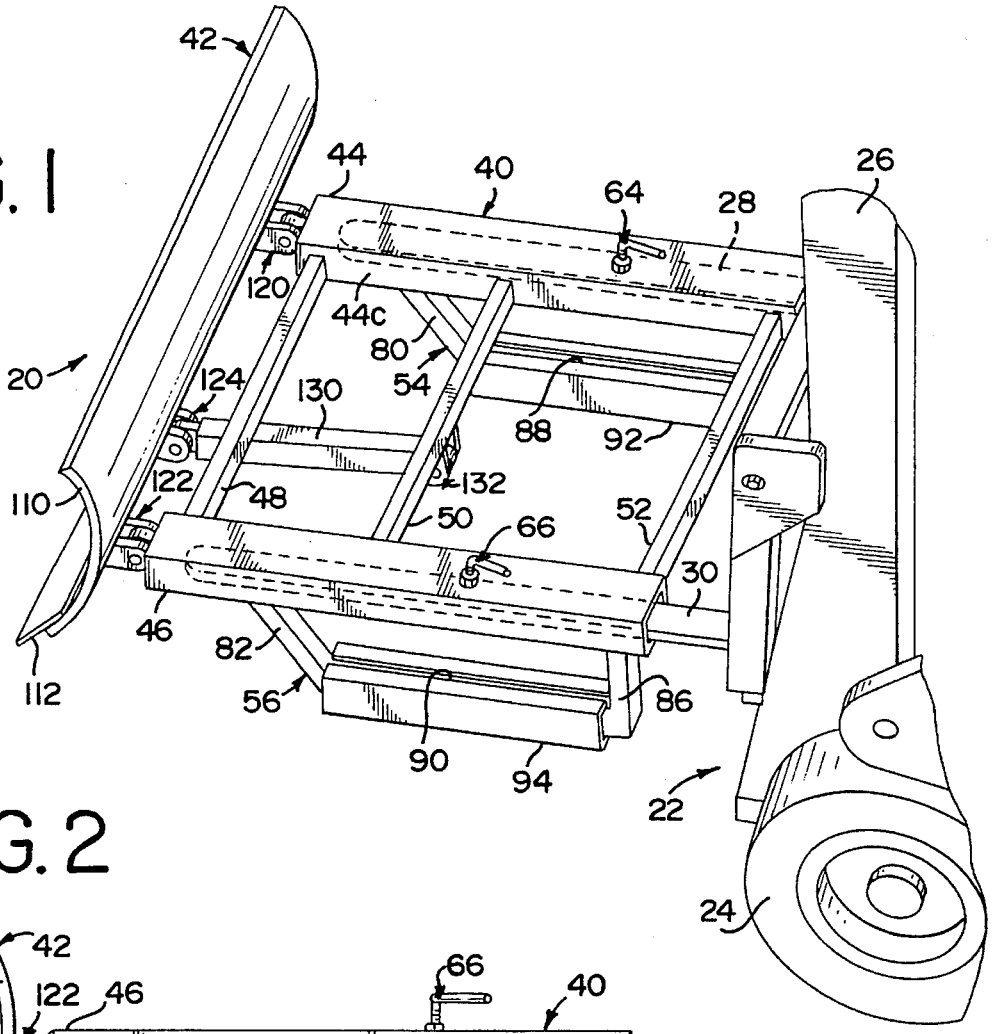
FIG. 1 is a perspective view of the plow attachment of the present invention mounted on the tines of a standard forklift truck which is shown in fragmentary.

Referring now to the drawings, and particularly to FIGS. 1 to 5, the plow attachment of the present invention for use on a forklift truck, generally indicated by numeral 20, is releasably attachable to a conventional forklift truck 22. The forklift truck 22 includes a main body or vehicle supported by ground engaging wheels 24, a lifting and tilting mechanism 26 attached to the front of the main body, and a fork defined by two tines 28 and 30 extending substantially horizontally from the front of the lifting mechanism 26. The tines 28 and 30 may be vertically raised and lowered, tilted forward and backward to some degree, and moved closer or farther apart. The plow attachment 20 includes a frame 40 which is adapted to be releasably connected to the tines 28 and 30 and a blade or plow assembly 42 connected to the frame 40. The frame and the blade assembly of the plow forklift attachment of the present invention may be made from suitably strong steel which will withstand the forces subjected by the forklift truck and the tines. It should be appreciated that the plow attachment of the present invention could be made from other suitable materials or a combination of materials such as tough and/or light-weight plastics.

Figure 3:
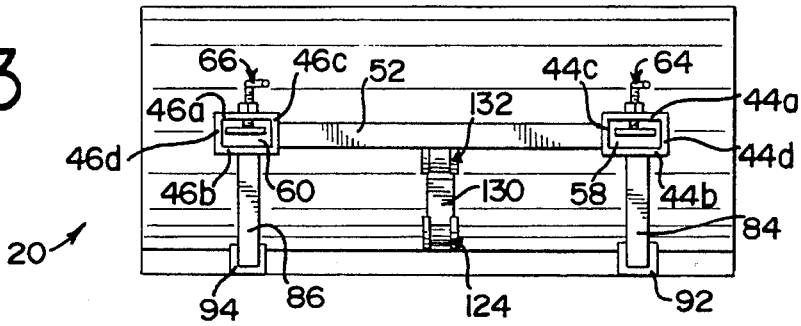
FIG. 3 is a rear view of the plow attachment.

The frame 40 of the plow attachment 20 generally includes two parallel spaced-apart elongated tubular members or tubes 44 and 46 interconnected by three spaced-apart transversely extending crossbars 48, 50, and 52. The frame 40 further includes ground-engaging members 54 and 56, respectively, which are attached to the bottom of each tube. More particularly, the rectangular elongated steel tubular members 44 and 46 have top walls 44*a* and 46*a*, bottom walls 44*b* and 46*b*, interior side walls 44*c* and 46*c*, and exterior side walls 44*d* and 46*d*, respectively, as best illustrated in FIGS. 3 and 6. The crossbars 48, 50, and 52 are likewise formed from tubular steel members, the ends of which are attached to and between the interior walls 44*c* and 46*c* of tubes 44 and 46. The crossbars may be attached to the tubes by welding, or alternatively could be attached by other suitable methods such as by conventional connectors or brackets. Tubes 44 and 46 have openings 58 and 60 sized to receive the tines 28 and 30, as seen in FIGS. 1, 3, and 6. Tubes 44 and 46 are preferably of a sufficient length and size such that they freely receive a significant portion of the length of the tines when the tines are inserted into the tubes. This enables the operator of the forklift to control the height and tilt of the plow attachment through the movement of lift mechanism 26 and the tines 28 and 30.

The tubes 44 and 46 further include locking mechanisms 64 and 66 for releasably connecting or securing the tubes to selected positions on the tines after the plow attachment 20 is mounted on the tines. More specifically, locking mechanism 66, as seen in greater detail in FIG. 6, includes a threaded shaft 70 which is threadedly received in a conventional hex nut 72 having an interior screw-threaded surface. The bottom surface of the hex nut 72 is welded or otherwise suitably secured to the upper surface of the top wall 46*a* of tube 46 and is positioned above an aperture 74 formed in the top wall 46*a*. The aperture 74 is sized larger than the shaft 70 to allow the shaft to freely rotate into and out of tube 46. Alternatively, the top wall 46*a* could be constructed with an aperture having an interior screw-threaded surface for threadedly receiving the shaft 70, thereby eliminating the need for the hex nut 72. For either case, the shaft 70 has two ends, one end disposed inside tube 46 and the opposite end disposed outside the tube 46 above the top wall 46*a*. A handle 76 for rotating the shaft is suitably attached to the exposed or outer end of the shaft 70. A hold-down plate 78 is suitably attached to the opposite end of shaft 70 which is disposed within the tube 46. The hold-down plate 78 is circular, although it may have any suitable configuration. Once the tine 30 is inserted into the tube, the handle 76 is manually rotated clockwise to lower the hold-down plate 78 into tightened engagement with the tine 30, thereby locking the plow attachment 20 to the forklift truck 22. Depending upon the length of the tines, the end of the tines may engage the interior surface of the end wall 46*c* in each tube. Also depending upon the length of the tines, the ends of the tubes adjacent openings 58 and 60 may abut against the lift member 26. The bottom surface of the hold-down plate 78 is adapted to engage the top surface of the tine 30 to maintain the tube at a preselected position on the tine. When the user desires to remove the plow attachment from the forklift, the hold-down plate 78 is disengaged from the tine 30 by manually rotating the handle 76 counterclockwise, thereby raising the hold-down plate 78 away from the tine. The tine may then be removed from the tube. The bottom surface of the hold-down plate may be suitably formed or provided with a material to increase the frictional engagement between the hold-down plate and the tine.

As noted above, the frame 40 includes ground-engaging members 54 and 56 extending downwardly from the tubes 44 and 46, respectively. The ground-engaging members 54 and 56 are constructed from steel tubular front legs 80 and 82 and steel tubular rear legs 84 and 86, all of which are suitably attached to the bottom walls 44*b* and 46*b* of the tubes 44 and 46, such as by welding. The rear legs 84 and 86 extend substantially vertically downwardly from the tubes while the front legs 80 and 82 extend downwardly at an angle and rearwardly toward the rear legs. This allows space for the blade to pivot backward when the blade hits an obstruction in its path and the shear pin breaks, as discussed below. The lower ends of the front and rear legs are suitably connected to steel tubular ground-engaging feet 88 and 90, respectively. The feet 88 and 90 extend substantially horizontally between the front and rear legs and engage the ground when the plow attachment 20 is unattached to the forklift truck. These ground-engaging members 54 and 56 maintain the tubes in a substantially horizontal position prior to and during the insertion of the tines into the tubes to facilitate the insertion and removal of the tines from the tubes.

The feet 88 and 90 have removable and/or replaceable shoes 92 and 94 which are snugly snapped or mounted thereon for engaging the ground as the plow attachment moves or slides along the ground. As further illustrated in FIG. 8, shoe 94 is an elongated U-shaped member which includes a ground-engaging sole 96, two spaced-apart upstanding side members 98 and 100 connected to the sole 96 at substantially right angles, and two opposing spaced-apart flanges or tongues 102 and 104 connected to the top ends of the sides 98 and 100 at substantially right angles. Shoe 94 is thereby adapted to snap on to the foot 90 and, when the sole is worn, snap off the foot prior to replacement. The shoes 92 and 94 are preferably made from a plastic material having a low coefficient of friction and/or a self-lubricating plastic material. In addition to reducing the friction between the plow attachment and the ground, the shoes protect the pavement and legs against metal-to-pavement contact, thus providing a replaceable wear element. An example of the material used for the shoe would be Delrin, which is a registered trademark of E. I. Du Pont de Nemours & Co., Inc. of Wilmington Del. The shoes may be formed in other suitable configurations and may be made from other suitable materials. Further, the entire ground-engaging member could be made of plastic.

The plow attachment 20, as noted above, has a blade assembly 42. The blade assembly 42 includes a standard blade 110 suitably sized and bent in a concave shape for clearing snow or other materials. The blade is preferably made of steel, but could be made of other suitable materials. A conventional resilient sweep member 112 made of rubber or plastic as is well known in the blade art is attached to the bottom of the blade for engaging the ground. The resiliency of the sweep member allows the blade to engage protrusions and/or minor obstructions without damage to the blade as well as preventing excessive wear to the blade. The sweep member 112 is preferably replaceable. The bottom of the blade assembly and the ground-engaging members are aligned in substantially the same plane such that the plow attachment standing alone rests in a substantially horizontal position. Moreover, when the plow attachment 20 is lowered by the forklift into engagement with the ground to clear materials such as snow, the ground-engaging members coact to cause the blade to contact the ground at the appropriate angle without the blade digging into the ground.

The blade assembly 42 is pivotally attached to the frame 40 by conventional knuckle joints 120, 122, and 124. Knuckle joints 120 and 122 are attached to the closed ends 44*e* and 46*e* of the tubes 44 and 46 and provide a pivotal connection at the back of the blade 110. The knuckle joints 120 and 122 are attached to the blade at a level to properly position the blade on the frame such that the blade will properly engage the floor during operation. The knuckle joints 120 and 122 include male projections 120*a* and 122*a* and female projections 120*b* and 122*b*, respectively. Each of the projections have horizontally aligned disposed eyes or slots (not shown) adapted to receive a pin (not shown) in a conventional manner to pivotally connect the blade to the tubes. While the female projections are shown attached to the blade and the male projections are shown attached to the tubes, their positions could be reversed. Moreover, other conventional fastening methods could be employed to pivotally attach the blade to the frame 40 on a horizontal axis.

Figure 2:
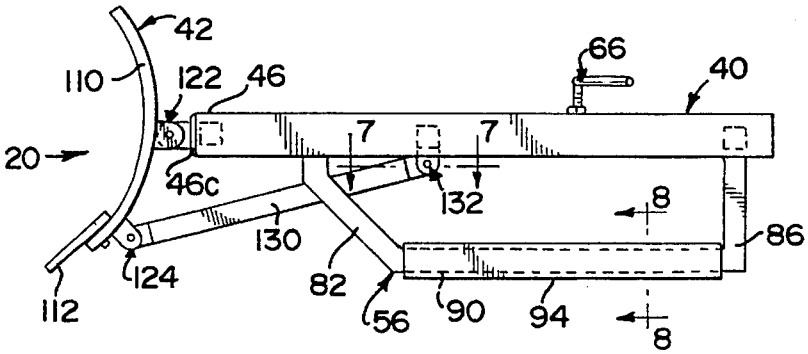
FIG. 2 is a side view of the plow attachment.

The third knuckle joint 124 is attached to the back of the blade at a lower horizontal level than knuckle joints 120 and 122, as seen in FIG. 2. More specifically, the female projections 124*b* of the knuckle joint 124 are attached to the blade and the male projection 124*a* is attached to one end of a shear bar 130 to pivotally connect the blade to the bar. The tubular steel shear bar 130 extends at an angle from the blade upwardly and is pivotally connected to the crossbar 50 by a further knuckle joint and shear pin assembly 132, as illustrated in FIG. 7. This knuckle joint and shear pin assembly 132 includes a pair of female projections 134*a* and 134*b* attached to and extending downwardly from the bottom of the crossbar 50, and a single male projection 136 attached to the end of the shear bar 130. The male and female projections define corresponding horizontally extending eyes which are adapted to receive a conventional shear pin 138. When the ground is too steep and or when the blade hits or engages an obstruction in its path, the force of which is greater than the strength of the shear pin 138, the shear pin breaks and the blade pivots backward about knuckle joints 120 and 122 to avoid damage to the blade. The blade does not engage the front legs 80 and 82 because they are angled toward the rear of the plow attachment. After the shear pin is broken, the blade must be pivoted back to its original position, the broken shear pin pieces must be removed, and a new shear pin must be inserted to continue to use the plow. In such situations, adjustment of the height and/or angle of the tines may be necessary to replace the shear pin and/or to continue plowing operations. This simple construction significantly reduces the costs of the plow attachment of the present invention and prevents the blade from being damaged. It will be appreciated that the shear pin may have a head on one end and a standard C-ring lock on the other end to maintain the pin in the knuckle joint.

An alternative embodiment of the plow forklift attachment of the present invention, generally indicated by numeral 100, is illustrated in FIGS. 9 to 12. The forklift attachment 100 is similar to forklift attachment 20 except that it includes hinge assemblies 152 for pivotally connecting the crossbars 48, 50, and 52 to the tubular members 44 and 46, and hinge assemblies 170 for attaching the frame 40 to the blade assembly 42 for pivotal movement on both horizontal and vertical axes.

Figure 10:
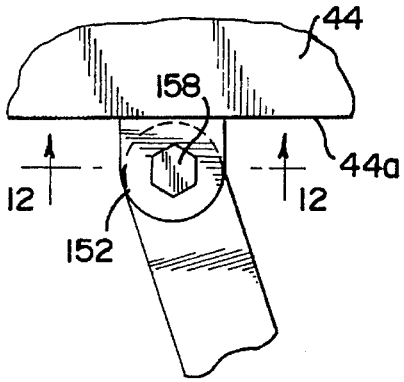
FIG. 10 is an enlarged fragmentary top plan view of the hinge joint between the crossbar and the tubular member of the plow attachment of FIG. 9.
Figure 12:
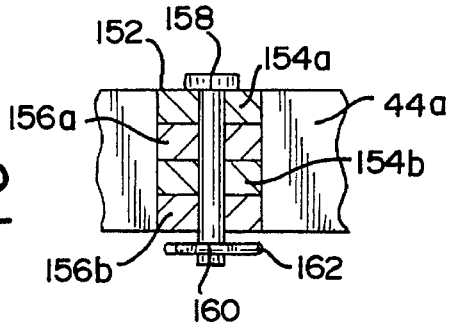
FIG. 12 is a enlarged cross-sectional view of the hinge joint taken substantially along line 12—12 of FIG. 10.

Each hinge assembly 152 may consist of a knuckle joint as described above, or may be similar to a door-type hinge as further illustrated in FIGS. 10 and 12 to allow suitable pivot movement between the crossbars and tubular members. For example, hinge 152 connecting tube 44 and crossbar 52 includes a pair of semi-cylindrical projections 154*a* and 154*b* attached to the interior wall 44*a* of tube 44 and a pair of semi-cylindrical projections 156*a* and 156*b* attached to the end of the crossbar 52. These projections define vertically extending eyes or apertures through which a pin or a bolt 158 is inserted to connect the crossbar to the tube. The pin 158 preferably includes a slot 160 for a linchpin 162 or other suitable locking means which releasably locks the pin 158 in place while allowing for the removal of the pin and easy disassembly of the plow attachment 150. If a bolt is employed, a standard collar, lock washer and nut could be used to complete the hinge assembly.

Figure 9:
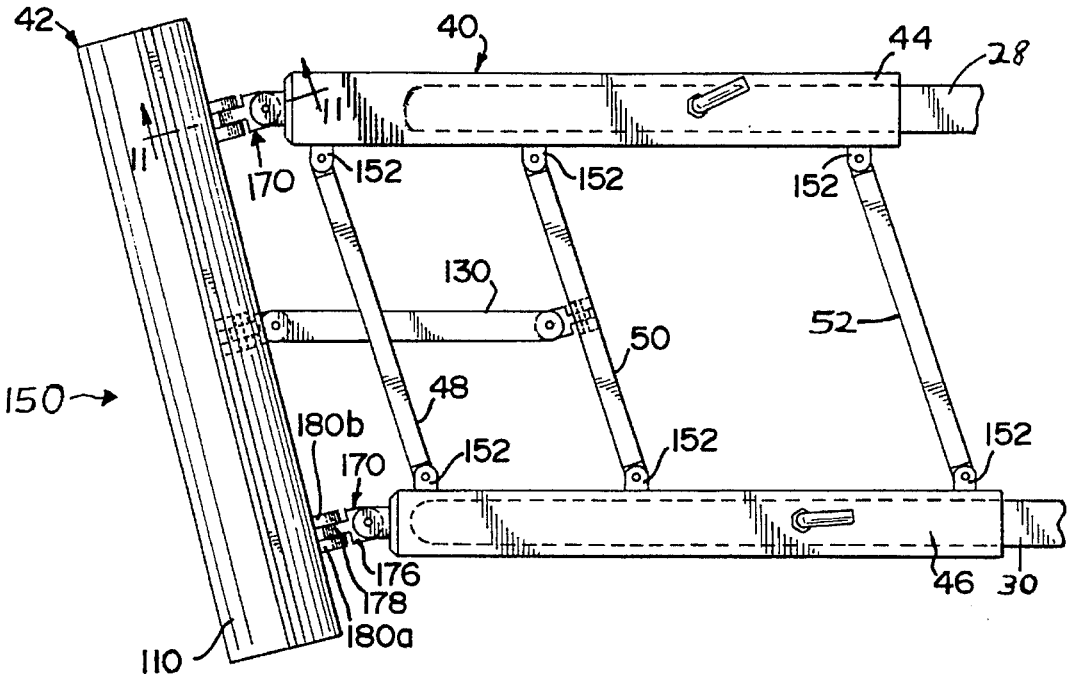
FIG. 9 is a perspective view of a further embodiment of the plow attachment of the present invention mounted on the tines of a forklift truck and having an adjustably anglable blade.
Figure 11:
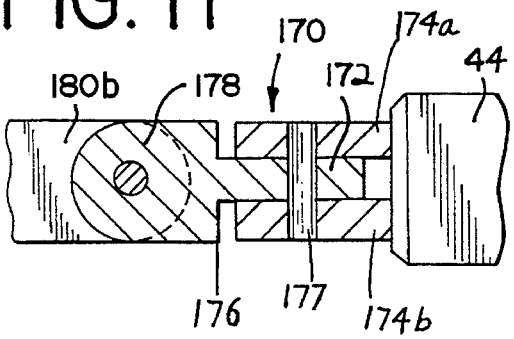
FIG. 11 is a enlarged cross-sectional view of the hinge assembly attaching the blade to the tubular member of the plow attachment of FIG. 9 taken substantially along line 11—11 of FIG. 9.

Forklift attachment 150 further includes hinge assemblies 170 for connecting the frame 40 to the blade 110 which define both horizontal and vertical pivot axes to allow pivotal movement horizontally and vertically, as illustrated in FIGS. 9 and 11. Hinge assembly 170 includes a pair of female projections 174*a* and 174*b* attached to and extending from the end of tubular member, opposite opening 60, and a male projection 172 attached to and extending from one side of a bracket 176. The projection 172 has a vertically extending eye adapted to align with eyes in projections 174*a* and 174*b* for suitably receiving pin 177. The opposite side of bracket 176 has a male projection 178 adapted to mate with two female projections 180*a* and 180*b* attached to the blade 110. This arrangement defines a universal connection that provides for the angling of the blade in conjunction with the frame and for the pivoting of the blade relative to the frame. This type of hinge assembly also connects the shear bar 130 to both the blade and the crossbar 50. It should be appreciated that the construction of the hinges or joints could vary in keeping with the present invention.

This hinged arrangement of the plow attachment of the present invention enables the user to place the tubes on the tines at different positions to angle the blade as desired, as specifically shown in FIG. 9. This allows the user to push the snow or other materials straight ahead, or either to the right or left of the truck, depending on the location desired for the plowed material. This also allows the user to change the direction of the blade at any time during use, and it will be appreciated a lever arrangement could be provided to assist in angling the plow.

This hinged construction further facilitates the shipment of the plow attachment to the customer unassembled, as pins and linchpins may be used at each pivot connection, and allows the customer to easily and quickly assemble the plow attachment. Likewise, this construction allows the plow attachment to be disassembled when not in use. When disassembled, the plow attachment would use a minimum of storage space.

Although not shown in FIGS. 1 to 12, a further embodiment of the present invention includes one or more tine stopping pins or members which may be inserted into the tubular member for preventing the tine from moving forward in the tubular members due to the force of the blade against pushing the material such as show. More particularly, one or more sets of aligned vertical holes may be formed in the top and bottom walls of the blade end of tubular members. A pin or bolt may be inserted in and suitably secured in the set of aligned holes to provide a stop member in the tube which is adapted to engage the end of the tine. This stop member would prevent the tines from sliding further into the tube due to forces on the blade during normal operation.

It will be understood that modifications and variations may be effected without departing from the scope of the novel concepts of the present invention, but it is understood that this application is to be limited only by the scope of the appended claims.

The invention is hereby claimed as follows:

1. An attachment for a forklift truck wherein the forklift truck includes a main body, a lift mechanism attached to the front of the body, and a plurality of tines extending from said lift mechanism, said attachment comprising:

blade means for moving material along the ground, said blade means including a concave member having a lower edge engageable with the ground, means for releasably connecting said blade means to said tines, said connecting means including interconnected tine-receiving members, means for pivotally connecting said blade means directly to each said tine-receiving member along a substantially horizontal axis and centrally of said blade means, and means between said tine-receiving members and said blade means for preventing damage to said blade means when the blade means engages uneven ground and/or obstructions along the ground, said damage preventing means connected to said blade means at an off center joint along the blade means alloy pivoting of the blade means backwardly about said substantially horizontal axis.

2. The attachment of claim 1, wherein said tine-receiving members are interconnected by at least one transversely extending crossbar.

3. The attachment of claim 2, which further includes means connected to said tine-receiving members for engaging the ground to maintain said blade means at a working level.

4. The attachment of claim 3, wherein said ground-engaging means includes at least one leg extending downwardly from each tine-receiving member.

5. The attachment of claim 4, wherein said ground-engaging means further includes a foot attached to each leg and replaceable shoes means attached to each foot for slidably engaging the ground as the attachment moves along the ground.

6. The attachment of claim 5, wherein said shoes means are made from a plastic material having a low coefficient of friction.

7. The attachment of claim 1, wherein said means for preventing damage to said blade means includes a shear pin assembly having a shear pin which breaks when sufficient force is applied to said blade means.

8. The attachment of claim 2, wherein said crossbar is connected to said tine-receiving members by hinge means to permit the placement of the tine-receiving members on the tines at positions which allows the angling of the blade means in either direction.

9. The attachment of claim 2, wherein a plurality of crossbars are connected to said tine-receiving members by hinge means to permit the placement of the tine-receiving members on the tines at positions which allows the angling of the blade means in either direction.

10. An attachment for a forklift truck wherein the forklift truck includes a main body, a lift mechanism attached to the front of the body, and a plurality of tines extending from said lift mechanism, said attachment comprising:

a plow means for moving materials along the ground, said plow means including a concave member having a lower edge engageable with the ground, a frame means for releasably attaching said plow means to the tines of said forklift truck, said frame means including tubular means having an opening at one end for receiving said tines, means for directly pivotally connecting said plow means to the end of the tubular means opposite said open ends and along a substantially horizontal axis at a point centrally along said plow means, and locking means for releasably engaging a surface of said tines to secure said tubular means to said tines, said locking means at least partially disposed in said tubular means, and means connected between said frame means and said plow means at a vertically off-center point along said plow means for preventing damage to said plow means when said plow means engages uneven ground and/or obstructions along the ground.

11. The attachment of claim 10, wherein said tubular means includes a plurality of substantially parallel tubes adapted to receive said tines and connected by a plurality of transversely extending substantially parallel crossbars.

12. The attachment of claim 11, wherein said frame means includes downwardly extending legs connected to said tubes and having feet for engaging said ground to facilitate the insertion and removal of the tines into and out of the tubes and maintain the plow means at a working level with the ground.

13. The attachment of claim 12, wherein said frame means further includes replaceable plastic shoes connected to said feet.

14. The attachment of claim 10, wherein said means for preventing damage to said plow means includes a shear pin disposed between one of said crossbars and said plow means.

15. An attachment for a forklift truck wherein the forklift truck includes a main body, a lift mechanism attached to the front of the body, and a pair of tines extending from said lift mechanism, said attachment comprising:

a frame including a pair of tubes which are adapted to receive said tines, locking means disposed partially in said tubes for releasably engaging said tines to secure said tubes to said tines, at least one crossbar connected to said tubes by hinge assemblies that permit the angling of the blade in either direction, and leg means for engaging the ground attached to each tube, each tube locking means including a tine-engaging plate disposed in said tube, a shaft connected at one end to said plate and extending through said tube, and a handle connected at the end of the shaft opposite the plate, a blade adapted to move material along the ground attached to said frame, means connecting said frame and said blade for preventing damage to said blade when the blade engages uneven ground and/or obstructions along the ground in the path of the blade.

16. The attachment of claim 15, wherein said tubes are of a length to cover a significant portion of the tines.

17. The attachment of claim 15, wherein said plate includes means on the tine-engaging side of the plate to increase the frictional engagement between the plate and the tine.

18. An attachment for a forklift truck wherein the forklift truck includes a main body, a lift mechanism attached to the body, and at least a pair of tines extending from said lift mechanism, said attachment comprising:

blade means for moving material along the ground, means for releasably connecting said blade means to said tines including at least a pair of spaced-apart tine-receiving members interconnected by at least one crossbar wherein said crossbar is connected to said tine-receiving members by hinge means to permit the placement of the tine-receiving members on the tines at positions which allow the angling of the blade means in either direction.

19. The attachment of claim 18, which includes a plurality of crossbars connected between said tine-receiving members by hinge means.

20. The attachment of claim 18, which further includes means connected to said blade connecting means for engaging the ground to maintain said blade means at a working level.

21. The attachment of claim 18, which further includes means between said releasably connecting means and said blade means for preventing damage to said blade means when the blade means engages uneven ground and/or obstructions along the ground.

22. The attachment of claim 18, which further includes a tine-stopping member means for insertion into one of a plurality of substantially vertically extending holes in one of the tine-receiving members to prevent the tine-receiving member from moving toward the truck due to the force of the material against the blade means to maintain the blade means at an angle.

23. An attachment for a forklift truck wherein the forklift truck includes a main body, a lift mechanism attached to the front of the body, and a plurality of tines extending from said lift mechanism, said attachment comprising:

a plow means for moving materials along the ground, a frame means for releasably attaching said plow means to the tines of said forklift truck, said frame means including means for receiving said tines, means on said tine-receiving means for releasably securing said tine-receiving means to said tines, and hinge means for permitting the placement of said tine-receiving means on the tines at positions which facilitate the angling of the plow means, and means connected between said frame means and said plow means for preventing damage to said plow means when said plow means engages uneven ground and/or obstructions along the ground.

24. The attachment of claim 23, wherein said means for receiving said tines includes a pair of substantially parallel tubes sized to receive a significant portion of said tines and a plurality of transversely extending substantially parallel crossbars connected to said tubes by said angle permitting means.

25. An attachment for a forklift truck wherein the forklift truck includes a main body, a lift mechanism attached to the front of the body, and a pair of tines extending from said lift mechanism, said attachment comprising:

a frame including a pair of tubes which are adapted to receive said tines, means on said tubes for releasably securing said tines in said tubes, at least one crossbar connecting said tubes, and a hinge connecting each tube to said crossbar, a blade adapted to move material along the ground pivotally attached to said frame, and means connecting said frame and said blade for preventing damage to said blade when said blade engages uneven ground and/or obstructions along the ground in the path of said blade.

26. An attachment for a forklift truck wherein the forklift truck includes a main body, a lift mechanism attached to the body, and a pair of tines extending from said lift mechanism, said attachment comprising:

a frame including a pair of tubes which are adapted to receive said tines and at least one crossbar connecting said tubes, a concave blade adapted to move material along the ground, said blade having a lower edge engagable with said ground, means for directly pivotally attaching said blade to said tubes along a substantially horizontal axis at a point centrally along said blade, and means extending from said crossbar for connecting said blade to said crossbar at a vertically off-center point along said blade.

27. An attachment for a forklift truck wherein the forklift truck includes a main body, a lift mechanism attached to the front of the body, and a plurality of tines extending from said lift mechanism, said attachment comprising:

blade means for moving material along the ground, said blade means including a concave member having a lower edge engageable with said ground, means for releasably connecting said blade means to said tines, said connecting means including spaced-apart tine-receiving members, means for pivotally connecting said blade means to said tine-receiving members along a substantially horizontal axis and centrally of said blade means, and at least one transversely extending crossbar means for interconnecting said tine-receiving members, and means between said tine-receiving members and said blade means for preventing damage to said blade means when the blade means engages uneven ground and/or obstructions along the ground, said damage preventing means including a shear bar pivotally connected at one end to said blade means at a vertically off-center point along said blade means and at the other end to said crossbar by a shear pin.

28. The attachment of claim 27, wherein said shear bar is pivotally connected to said blade means on a substantially horizontal axis below said horizontal axis on which said blade means is connected to said tine-receiving members.

* * * * *

UNITED STATES PATENT AND TRADEMARK OFFICE

CERTIFICATE OF CORRECTION

PATENT NO. : 5,560,129

DATED : October 1, 1996

INVENTOR(S) : Michael B. Rothbart

It is certified that error appears in the above-identified patent and that said Letters Patent is hereby corrected as shown below:

Col. 5, line 63, change "100" to --150--;
line 64, change "100" to --150--;
Col. 7, line 31, change "joint" to --point--.
line 31, change "alloy" to --allow--.

Signed and Sealed this

Twenty-first Day of January, 1997

*Attest:*

*Attesting Officer*

BRUCE LEHMAN

*Commissioner of Patents and Trademarks*